US005673465A

United States Patent [19]

Singapuri

[11] Patent Number: 5,673,465

[45] Date of Patent: Oct. 7, 1997

[54] SPRING-ACTUATED JEWELRY PIECE

[76] Inventor: Bhupen Singapuri, 300 Larkin St., San Francisco, Calif. 94109

[21] Appl. No.: 658,127

[22] Filed: Jun. 4, 1996

[51] Int. Cl.[6] ..... A44B 9/12

[52] U.S. Cl. ..... 24/709.4; 24/66.8

[58] Field of Search ..... 24/66.4, 66.8, 24/66.9, 709.1, 709.2, 67.9, 709.4

[56] References Cited

U.S. PATENT DOCUMENTS

| | | | |
|---|---|---|---|
| 373,482 | 11/1887 | Purdy | 24/709.2 |
| 590,904 | 9/1897 | O'Brien . | |
| 866,943 | 9/1907 | Long | 24/66.8 X |
| 1,647,962 | 11/1927 | Fenton . | |
| 1,787,143 | 12/1930 | Clark et al. . | |
| 2,454,857 | 11/1948 | Bish | 24/66.8 X |
| 2,581,274 | 1/1952 | Mix | 24/66.8 |
| 2,608,729 | 9/1952 | Meeker | 24/66.8 |
| 2,723,429 | 11/1955 | Botts | 24/66.8 |
| 5,361,459 | 11/1994 | Hyvonen et al. | 24/66.8 X |

FOREIGN PATENT DOCUMENTS

| | | |
|---|---|---|
| 374780 | 7/1932 | United Kingdom . |

*Primary Examiner*—Peter M. Cuomo
*Assistant Examiner*—Stephen Vu
*Attorney, Agent, or Firm*—Watson Cole Stevens Davis, PLLC

[57] ABSTRACT

A spring actuated jewelry piece for attachment to clothing material includes a decorative backing plate, a bracket assembly having a fixed bracket member mounted to the decorative backing plate and a rotatable bracket member rotatably mounted about a pivot on the fixed bracket member. A pin is attached to the rotatable bracket member at a portion remote from a sharpened end portion of the pin. Clothing material is engaged between the sharpened end portion of the pin and the decorative backing plate, and a flexed, leaf-type spring is mounted within, and substantially along the axis of, the pin and includes an end portion extending within the movable bracket to engage the fixed bracket member. The spring extends from the movable bracket partially toward the sharpened end portion of the pin to provide a constant force to close the pin against the decorative backing plate.

6 Claims, 1 Drawing Sheet

SPRING-ACTUATED JEWELRY PIECE

BACKGROUND

1. Field of the Invention

This invention relates to the attachment of jewelry such as brooches, decorative pins and the like to clothing by spring-actuated fasteners and, more particularly, to such fasteners actuated merely by a fixed spring in a movable pin-like portion of the jewelry that is permanently biased into a closed position with the movable pin-like portion biased against a back plate of the jewelry and such that an article of clothing is clasped between the spring-biased pin-like portion and the back plate worn beneath the article of clothing. The jewelry is released simply by rotation of the pin-like portion against the biased spring, thereby removing the pressure of the pin against the article of clothing and the back plate.

2. Related Art

The following publications are believed to represent the state-of-the-art with respect to mechanism for attaching jewelry to clothing.

(1) U.S. Pat. No. 1,647,962 to Fenton and entitled "Pin Stud Fastener" in which the pin stud is attached to an article of clothing by being resiliently clasped between flanged portions of the stud on one side of the article and portions of the pin on the other.

(2) U.S. Pat. No. 1,787,143 to Clark et al. and entitled "Snap Fastener" and wherein a pair of spaced pins are looped within a socket having teeth extending therefrom in a line extending parallel to the spaced pins. The pins are inserted through the material and the socket rotated so that the pins are inserted into an article of clothing by being sprung under the teeth and retained there.

(3) U.S. Pat. No. 590,904 to O'Brien and entitled "Hat Fastener" wherein a swingable hair pin with a plate-like head portion and a spring-pressed clamping plate is adapted to be forced toward the hair pin by a coiled spring.

(4) In British Patent No. 374,780 a brooch is formed by an upper jaw and a branched lower pin. The rotatable pin engages a coiled spring through a cam whereby rotation of the pin in one or the other direction respectively closes the brooch against the clothing or separates it therefrom and is locked in the closed position.

(5) There is also generally known to those skilled in the jewelry-making art an earring for pierced ears in which a rotatable pin portion of the earring is secured against a fixed stud by a spring-action induced by rotation of the pin portion against a cam formed by the stud so that the rotatable pin portion engages the stud and is retained there until the pin portion is rotated away from the cam to remove the spring pressure and thereby enabling the earring to be withdrawn from the pierced ear.

The above publications and known spring-operated jewelry structure disclose closure mechanisms using springs for attachment of a brooch or decorative pin to an article of clothing; however, each of these closure mechanisms is unduly complex and have disadvantages in the manner in which they are attached to the jewelry and/or the article of clothing. For example, they may not provide sufficient attachment force and may tend to tear the clothing, for example.

As evidenced from the above publications and known spring-operated closure mechanisms for jewelry, while there has been a considerable amount of development in the art of attaching brooches or decorative pins to clothing, there is a need for further simplification in the such art and, in particular, the mechanisms used for attaching the jewelry to the clothing of the wearer.

SUMMARY OF THE INVENTION

It is a primary object of the invention to provide a spring-actuated attachment mechanism for brooches and decorative pins.

It is a primary feature of the present invention to provide a closing or retaining force for attaching jewelry having a rotatable pin to clothing by a simple leaf-type spring mounted in the rotatable pin that rotates with respect to a back plate containing the support for the pin and which exerts a permanent closing bias to retain the pin portion against the article of clothing and the back plate.

It is a primary advantage of the present invention that the spring mechanism does not require any special support or attachment members, thereby avoiding the disadvantages and complications of attachment mechanisms associated with coiled spring type attachment mechanisms, for example.

Yet another object of the invention is to provide a snap-action movement of the rotatable pin for purposes of engaging and disengaging the rotatable pin from the backing plate and the article of clothing.

Yet another feature of the invention is to provide an attachment mechanism for jewelry of the type specified herein wherein the pin portion of the jewelry piece is released from engagement with the article of clothing and the back plate simply by rotation of the pin portion away from the article of clothing and the back plate and against the permanent bias of the leaf spring.

It is yet a further advantage of the invention to obtain a positive snap-action of the spring mechanism in jewelry attachment mechanisms of the type specified herein.

It is a further object of the present invention to provide a simplified spring-type closure mechanism for jewelry that is reliable and has a long life.

It is a further feature of the present invention that the movement of the leaf-type spring is restricted, thereby decreasing the tendency of the leaf-type spring to undergo material fatigue.

It is a further advantage of the invention that the leaf-type spring of the present invention does not require replacement during the life of the decorative pin or pendant.

It is yet a further object of the invention to provide a leaf-type spring closure mechanism that is easily secured to a rotatable pin to be hidden from view.

It is yet a further feature of the present invention to secure the leaf-type spring to the inside portion of a rotatable jewelry pin by jeweler's solder, adhesive or simply by wedging the spring into the pin portion and retaining it therein by a clamping action.

It is yet a further advantage of the present invention to provide a spring closure mechanism that avoids complex or bulky fastening means for securing the leaf-type spring to a jewelry pin.

It is still another object of the invention to provide a spring closure type mechanism of the type specified herein for a jewelry pin of the type specified herein that is small and light in weight.

It is still another feature of the invention that in a spring closure type mechanism of the type specified herein a leaf-type spring is attached to the inside of a movable jewelry pin or clasp so that it is permanently biased in a closed position and is opened by simple rotation of the movable pin or clasp against the spring bias.

It is still another advantage of the present invention that the only movable part of the spring-type closure mechanism is the jewelry pin or clasp that is rotated about a bracket supporting the pin or pendant which causes the leaf spring to flex and unflex depending on the direction of rotation of the pin or clasp portion.

BRIEF DESCRIPTION OF THE DRAWINGS

The above objects, features and advantages of the invention are readily apparent from the following description of preferred embodiments of the invention setting forth the best mode of carrying out the invention when taken in conjunction with the following drawings, wherein.

DETAILED DESCRIPTION

Figure 1A:
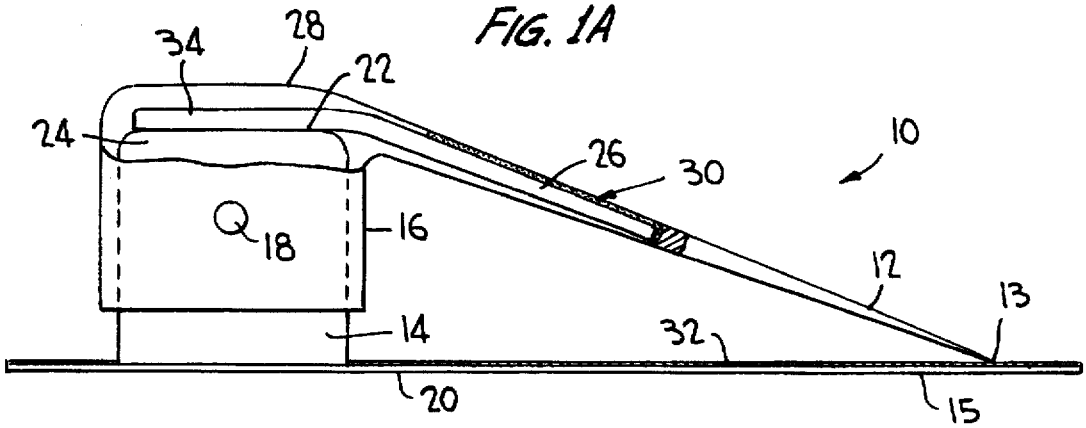
FIG. 1A is a partial side view of the spring-actuated jewelry attachment mechanism according to the invention and showing a rotatable pin in a closed position for clamping an article of clothing between the pin and a backing plate and with the leaf-type spring (as indicated by the broken lines) providing a spring force to cause the rotatable pin to be forced against an article of clothing between a backing plate and the pin, thereby securing the jewelry to the article of clothing.

With respect to FIG. 1A, jewelry piece 10 comprises support 14 extending upwardly from decorative backing plate 15 and pin 12 is attached to bracket 16 with bracket 16 and pin 12 being rotatable about pivot 18 in a manner known to those skilled in the jewelry art. It is not necessary to be able to remove pin 12 and bracket 14 from pivot 18 and support 16 to enable the jewelry piece 10 to be attached to clothing as the pin 12 has a pointed end portion 13 and the aforementioned components are sufficiently small so that they may be fit through the small hole made in the clothing by pin 12. Bracket 16 includes an engagement surface 22 which provides sliding support for spring 26 when pin 12 is rotated about pivot 18.

Jewelry piece 10 includes a leaf-type spring 26 mounted within the upper portion 28 of pin 12 by adhesive or jeweler's solder along a section of pin 12 generally designated by numeral 30 in FIG. 1A. The other end 34 of leaf-type spring 26 is not attached to upper portion 28 of pin 12 and is free to move along engagement surface 22 of bracket support 16 with rotation of pin 12 and support bracket 14. From FIG. 1A it is apparent that leaf spring 26 is bent in a manner to spring-bias pointed end portion 13 of pin 12 against clothing article 32 which is positioned against backing plate 20. In the position of pendant 10 shown in FIG. 1A so that pin 12 engages the clothing 32 to retain the jewelry piece 10 on clothing 32. That is the leaf-type spring 26 is flexed to constantly force pin 12 downwardly and against clothing 32 and decorative backing plate 20.

Figure 1B:
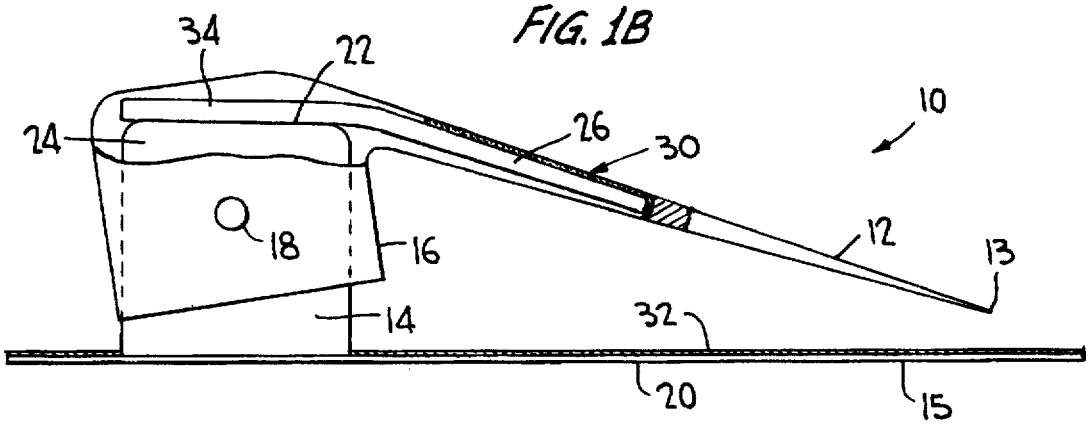
FIG. 1B is a partial side view of the spring-actuated attachment mechanism of FIG. 1A, but with the rotatable pin in an open position and rotated upwardly from the position shown in FIG. 1A against the force of the leaf-type spring (as indicated by the broken lines)

FIG. 1B illustrates the jewelry piece 10 with pin 12 thereof in the open position and disengaged from clothing 32 and ornamental backing plate 20 by upward, counter-clockwise rotation of pin 12 and support bracket 14 about pivot 18. Such rotation is enabled by the longitudinal movement of the upper portion 34 of leaf-type spring 26 along cam surface 24 of bracket 16 and is against the constant closing force produced by leaf-spring 26.

Figure 2:
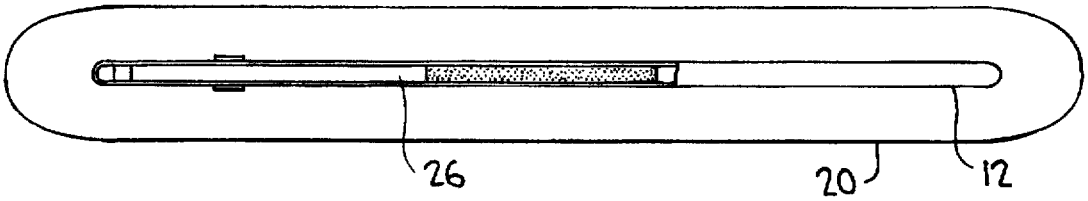
FIG. 2 is a partially cut away top view of the spring-action pin or pendant of FIGS. 1A and 1B showing the ornamental backing plate for engaging the clothing on the opposite side of the pin and for supporting the spring-actuated pin of the invention.

FIG. 2 shows a partial cut-away top view of the jewelry piece 10, ornamental backing plate 20, pin 12 and leaf-type spring 26. It is understood that ornamental backing plate 20 includes a decorative surface (not shown) which is positioned on the outside of the clothing when jewelry piece 10 is attached to the clothing 32. The height of brackets 14 and 16 is sufficiently small so that the jewelry piece 10 may be worn without discomfort. It is further understood that the hole in the article of clothing made by being pierced by the pin 12 and the passage of the pin 12 and brackets 14 and 16 through the hole made thereby does not cause unnecessary damage to the clothing to which the jewelry piece 10 is to be attached.

It is preferred that the leaf-type spring be made of spring steel or an equivalent material so as to provide sufficient force to retain the jewelry piece 10 on the clothing to which it is attached.

It is also readily apparent to one of ordinary skill in the jewelry art that the jewelry piece may be made of any desired size, i.e. to accommodate small, medium or large jewelry pieces.

The pin 12, brackets 14 and 16 and decorative backing plate 20 may be made of materials known to those skilled in the jewelry art. It is apparent that these components may have unfinished surfaces as such components are hidden from view.

The above description serves only to describe exemplary embodiments of the best mode of making the spring-actuated jewelry piece and to demonstrate the features and advantages of its construction and operation. The invention is not intended to be limited thereby, as those skilled in the jewelry art will readily perceive modifications of the above-described embodiments. Thus the invention is intended to be limited only by the following claims and the equivalents to which the claimed components thereof are entitled.

What is claimed is:

1. A spring-actuated jewelry piece for attachment to clothing material, comprising:

a decorative backing plate;

a bracket assembly having a fixed bracket member mounted to said decorative backing plate and a rotatable bracket member rotatably mounted about a pivot on said fixed bracket member;

a pin having a sharpened end portion for engaging clothing material between said sharpened end portion and said decorative backing plate, and said pin being attached to said rotatable bracket member at a portion remote from said sharpened end portion; and a flexed, leaf-type spring mounted substantially along the axis of said pin and having an end portion extending within said movable bracket and engaging said fixed bracket member and said spring extending from said movable bracket partially toward the sharpened end portion of said pin to provide a constant force to close said pin against said decorative backing plate.

2. A spring-actuated jewelry piece as claimed in claim 1, wherein said fixed bracket member includes a surface for supporting said end portion of said leaf-type spring extending within said movable bracket and enabling sliding movement of said spring with rotation of said pin about said pivot to close and open said pin on said decorative backing plate.

3. A spring-actuated jewelry piece as claimed in claim 1, wherein said leaf-type spring is mounted to said pin to provide a snap action release when said pin is disengaged from said decorative backing plate.

4. A spring-actuated jewelry piece as claimed in claim 1, wherein said leaf-type spring is fastened to said pin by jeweler's solder or adhesive.

5. A spring-actuated jewelry piece as claimed in claim 1, wherein said leaf-type spring is attached to said pin by wedging said spring inside said pin.

6. A spring-actuated jewelry piece as claimed in claim 1, wherein said leaf-type spring is made of spring steel or equivalent material to provide sufficient force to retain the jewelry piece on the clothing to which it is attached.

* * * * *